US008918968B2

(12) United States Patent
Rentz

(10) Patent No.: US 8,918,968 B2
(45) Date of Patent: Dec. 30, 2014

(54) LINK CLAMP

(75) Inventor: Matthew Rentz, Shelby Township, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 12/944,024

(22) Filed: Nov. 11, 2010

(65) Prior Publication Data

US 2012/0117767 A1 May 17, 2012

(51) Int. Cl.

*B25B 5/00* (2006.01)
*B25B 5/12* (2006.01)
*B25B 5/06* (2006.01)

(52) U.S. Cl.

CPC ..... *B25B 5/062* (2013.01)
USPC ..... 24/463; 24/603; 269/32

(58) Field of Classification Search

CPC ..... B25B 5/062
USPC ..... 269/24–37, 91, 93, 94, 228, 239, 285; 24/463, 603, 513, 568
See application file for complete search history.

(56) References Cited

U.S. PATENT DOCUMENTS

| | | | | |
|---|---|---|---|---|
| 4,637,597 | A * | 1/1987 | McPherson et al. | 269/32 |
| 5,165,670 | A * | 11/1992 | Sawdon | 269/32 |
| 5,503,378 | A | 4/1996 | Schauss et al. | |
| 5,694,042 | A | 12/1997 | Eaton et al. | |
| 5,875,417 | A | 2/1999 | Golden | |
| 5,996,984 | A | 12/1999 | Takahashi | |
| 6,059,277 | A * | 5/2000 | Sawdon et al. | 269/24 |
| 6,192,284 | B1 | 2/2001 | Golden | |
| 6,338,476 | B1 * | 1/2002 | Takahashi | 269/32 |
| 6,354,580 | B1 | 3/2002 | Nagai et al. | |
| 6,364,301 | B1 | 4/2002 | Takahashi | |
| 6,364,302 | B2 | 4/2002 | Ausilio | |
| 6,435,494 | B2 * | 8/2002 | Takahashi et al. | 269/32 |
| 6,439,560 | B2 * | 8/2002 | Sawada et al. | 269/32 |
| 6,641,189 | B2 | 11/2003 | Moilanen et al. | |
| 6,644,638 | B1 | 11/2003 | McCormick | |
| 6,685,177 | B2 * | 2/2004 | Dugas et al. | 269/32 |
| 6,691,994 | B2 * | 2/2004 | Kawakami | 269/309 |
| 6,883,795 | B2 | 4/2005 | McCormick et al. | |
| 6,886,822 | B2 * | 5/2005 | Kawakami | 269/309 |
| 6,948,708 | B2 | 9/2005 | Moilanen et al. | |
| 7,007,938 | B2 | 3/2006 | Nakata et al. | |
| 7,066,459 | B2 | 6/2006 | Tunkers | |
| 7,114,714 | B2 * | 10/2006 | Wong | 269/45 |
| 7,121,539 | B2 | 10/2006 | McCormick et al. | |
| 7,516,948 | B2 * | 4/2009 | McIntosh et al. | 269/32 |

(Continued)

FOREIGN PATENT DOCUMENTS

| | | |
|---|---|---|
| CN | 101277784 | 10/2008 |
| CN | 201309083 | 9/2009 |
| DE | 102006007995 | 10/2006 |
| JP | 07-196297 | 8/1995 |
| JP | 08-33923 | 2/1996 |

(Continued)

*Primary Examiner* — Robert J Sandy
*Assistant Examiner* — Louis Mercado
(74) *Attorney, Agent, or Firm* — Harness, Dickey & Pierce, P.L.C.

(57) ABSTRACT

A clamp has a housing with a piston assembly positioned in the housing. A piston rod lock assembly is coupled with the piston rod and is positioned in the housing. A clamping arm is coupled with the piston rod and moves from a position parallel to the piston rod, when in an unclamped position, to a position substantially perpendicular to the piston rod, when in a clamping position.

17 Claims, 3 Drawing Sheets

(56) References Cited

U.S. PATENT DOCUMENTS

| | | | | |
|---|---|---|---|---|
| 8,132,799 | B2 * | 3/2012 | McIntosh et al. | 269/32 |
| 8,132,800 | B2 * | 3/2012 | Tamai | 269/32 |
| 8,459,626 | B2 * | 6/2013 | Sawdon et al. | 269/228 |
| 2004/0115035 | A1 | 6/2004 | Tygard | |
| 2005/0035516 | A1 * | 2/2005 | Sawdon et al. | 269/32 |
| 2011/0291341 | A1 * | 12/2011 | Sawdon et al. | 269/216 |

FOREIGN PATENT DOCUMENTS

| | | |
|---|---|---|
| JP | 09-59905 | 3/1997 |
| JP | 9-136231 | 5/1997 |
| JP | 10-235494 | 9/1998 |
| JP | 2001-1274 | 1/2001 |
| JP | 2004-154917 | 6/2004 |
| JP | 2006-205331 | 8/2006 |

* cited by examiner

LINK CLAMP

FIELD

The present disclosure relates to clamps and, more particularly, to a link clamp.

BACKGROUND

Various types of clamping devices exist. Ordinarily, they include a clamping arm that is fixed to a piston rod assembly. The arm may pivot through a small angular movement from a clamped to an unclamped position. Additionally, the clamps may include fixed arms wherein the workpiece is moved in and out of the clamp head as the clamp moves between an opened and a closed position.

These clamps do not provide for an application where the clamp arm is positioned and retracted through an aperture in a fixture. These clamps do not enable the arm axis to move parallel with the piston rod axis.

The present disclosure provides a clamp that enables the clamping arm to move through an aperture in a fixture to a use position. The clamping arm is then retracted through the aperture. The clamping arm moves from a position where its longitudinal axis is parallel to the piston rod axis to a position where the axes are perpendicular to one another. The present disclosure provides a clamp that can be locked in position for an extended period of time. The present disclosure provides a clamp that has multiple orientations enabling it to be utilized in multiple positions.

SUMMARY

Accordingly to an aspect of the disclosure, a clamp comprises a housing that includes a piston assembly. The housing includes a cylindrical body and a head assembly. The piston assembly includes a piston rod moving between a first and a second position. A piston rod lock assembly is coupled with the piston rod. The piston rod lock assembly is positioned in the housing. An arm is coupled with the piston rod. The arm moves between a clamp and an unclamped position. The arm defines a longitudinal axis. The longitudinal axis moves from a position parallel to the piston rod to a position perpendicular to the piston rod. A biasing member maintains the arm in a position parallel to the piston rod. A link is coupled with the arm and the housing. The link moves the arm into a position perpendicular to the piston rod. The piston rod lock assembly is fluid activated between an ordinarily locked position, when the piston rod lock assembly is deactivated, and an unlocked position, when the piston rod lock assembly is activated. A clamp pad is positioned on the arm and is enabled to swivel about the arm.

According to a second aspect of the disclosure, a clamp comprises a housing with a piston assembly. The housing includes a cylindrical body and a head assembly. The piston assembly includes a piston rod moving between a first and a second position. An arm is coupled with the piston rod. The arm moves between a clamped and an unclamped position. The arm defines a longitudinal axis. The longitudinal axis moves from a position parallel to the piston rod, when the arm is in an unclamped position, to a position perpendicular to the piston rod, when the arm is in a clamped position. A biasing member maintains the arm in the position parallel to the piston rod axis. A link is coupled with the arm and the housing. The link moves the arm into the position perpendicular to the piston rod. A non-toggle mechanism locks the piston rod in position. A rod lock assembly is fluid activated between an ordinarily locked position, when the piston rod lock assembly is deactivated, and an unlocked position, when the piston rod lock assembly is activated.

According to a third aspect of the disclosure, a clamp comprises a housing with a piston assembly. The housing includes a cylindrical body and a head assembly. The piston assembly includes a piston rod moving between a first and a second position. An arm is coupled with the piston rod. The arm moves between a clamped and an unclamped position. The arm defines a longitudinal axis. The longitudinal axis moves from a position parallel to the piston rod, when the arm is in an unclamped position, to a position perpendicular to the piston rod, when the arm is in a clamped position. A biasing member maintains the arm in the position parallel to the piston rod. A link is coupled with the arm and the housing. The link moves the arm into the position perpendicular to the piston rod. A non-toggle mechanism locks the piston rod in position. A rod lock assembly is fluid activated between an ordinarily locked position, when the piston rod lock assembly is deactivated, and an unlocked position, when the piston rod lock assembly is activated.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 2:
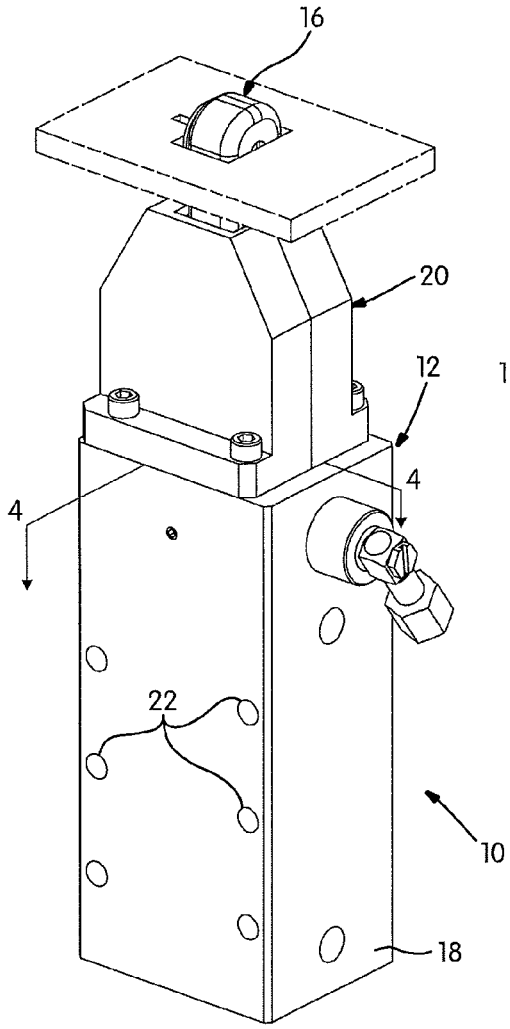
FIG. 2 is a view like FIG. 1 with the clamping arm in a retracted position.
Figure 1:
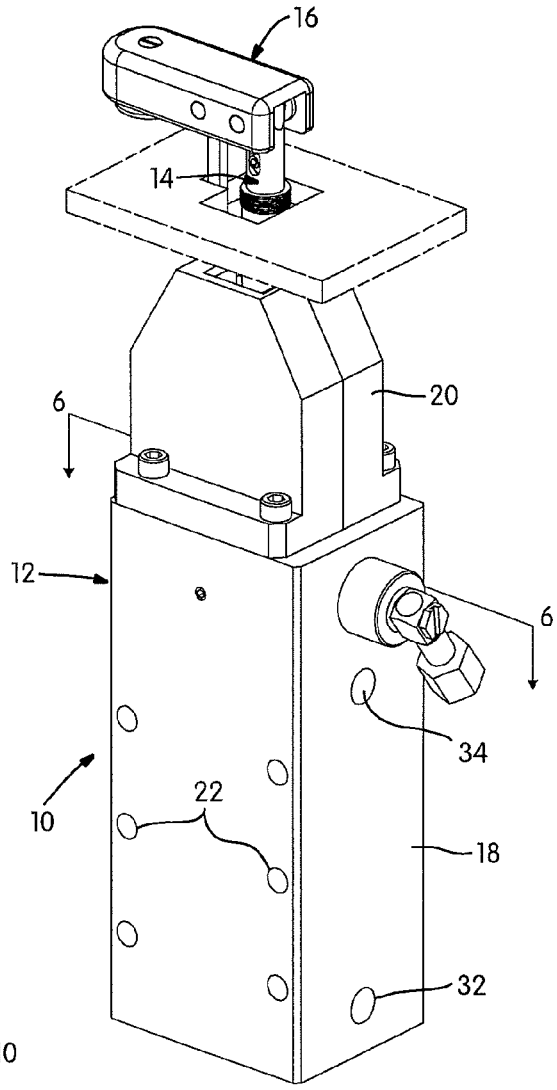
FIG. 1 is a perspective view of the clamp in accordance with the present disclosure.
Figure 3:
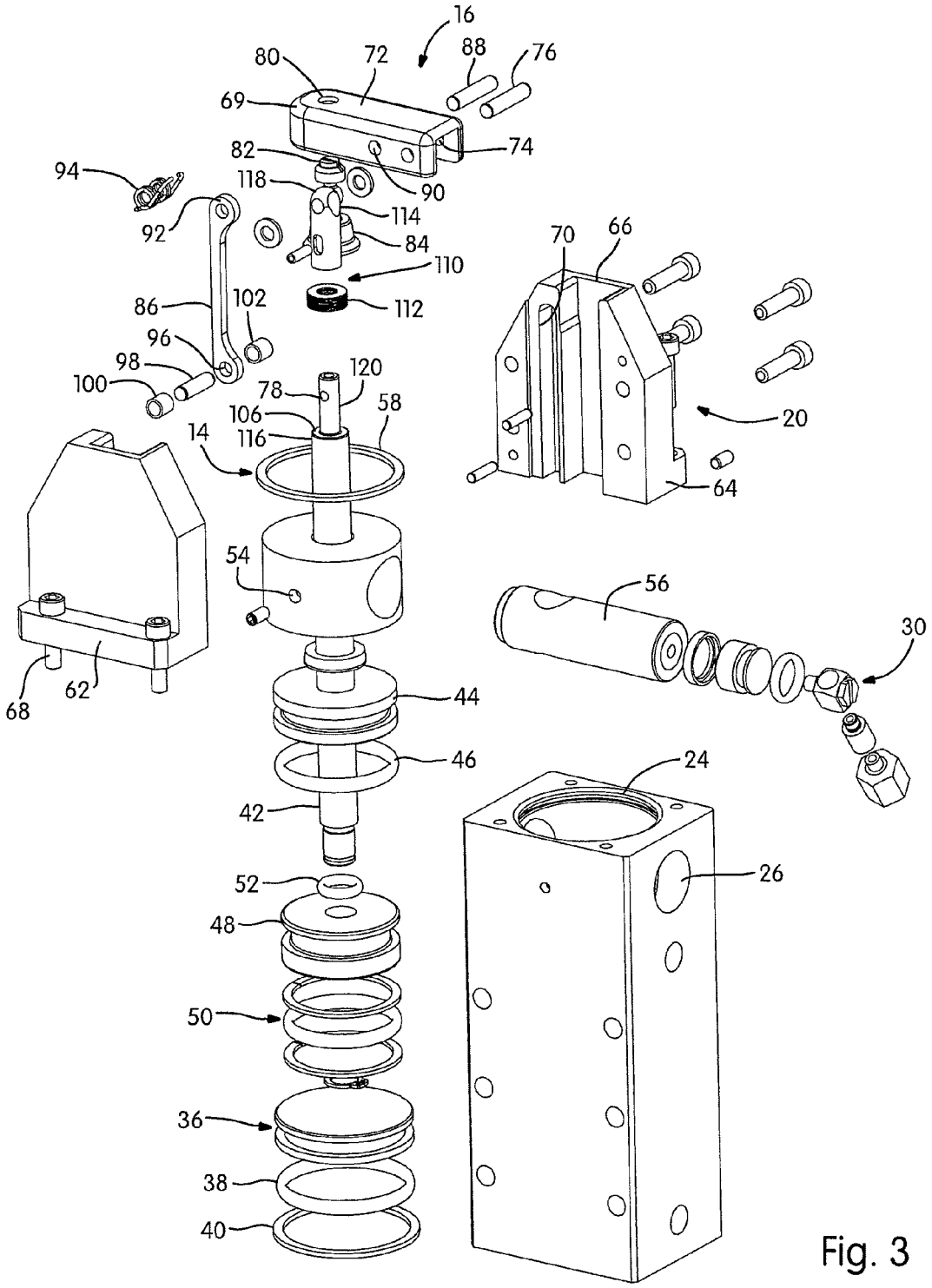
FIG. 3 is an exploded view of FIG. 1.

Turning to the figures, a link clamp is illustrated and designated with the reference numeral 10. The link clamp includes a body 12, a piston assembly 14, and a clamping arm 16. The body 12 includes a cylinder housing 18 and a head 20. The cylinder housing 18 houses a portion of the piston assembly 14. The housing 18 includes a plurality of apertures 22. The apertures 22 enable the housing to be connected to a support to position the clamp 10 onto the support. The remaining non-viewed sides of the housing include the same aperture pattern to enable the housing 18 to be positioned onto a support in various orientations. The housing 18 defines a cylinder bore 24 to receive the piston assembly 14. Additionally, the housing includes an aperture 26 that receives a rod lock assembly 30, which is a non-toggle mechanism. The cylinder housing 18 includes apertures 32 and 34 that enable the ingress and egress of fluid into the housing 18 to move the piston assembly 14 between its first and second position.

An end cap 36, including a seal 38, is positioned at one end of the cylindrical bore 24 sealing the cylindrical bore 24 and housing 18 at that end. A retaining ring 40 secures the end cap 36 and seal 38 in a sealing tight relationship with the housing 18.

Figure 4:
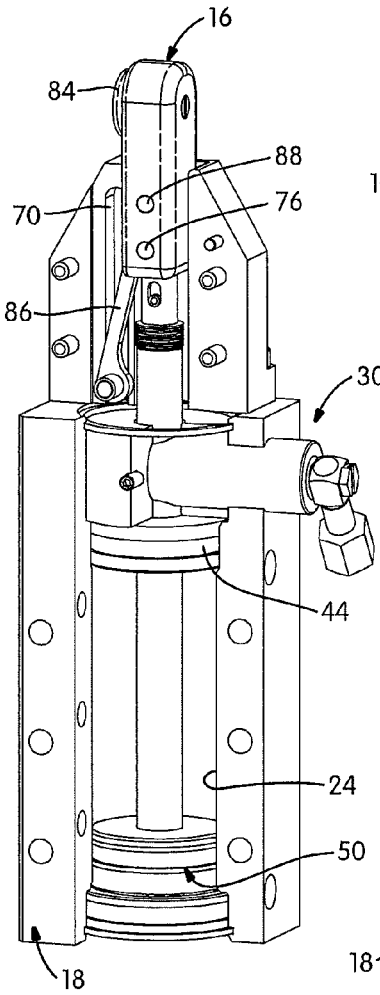
FIG. 4 is a cross-section view along line 4-4 of FIG. 2.
Figure 5:
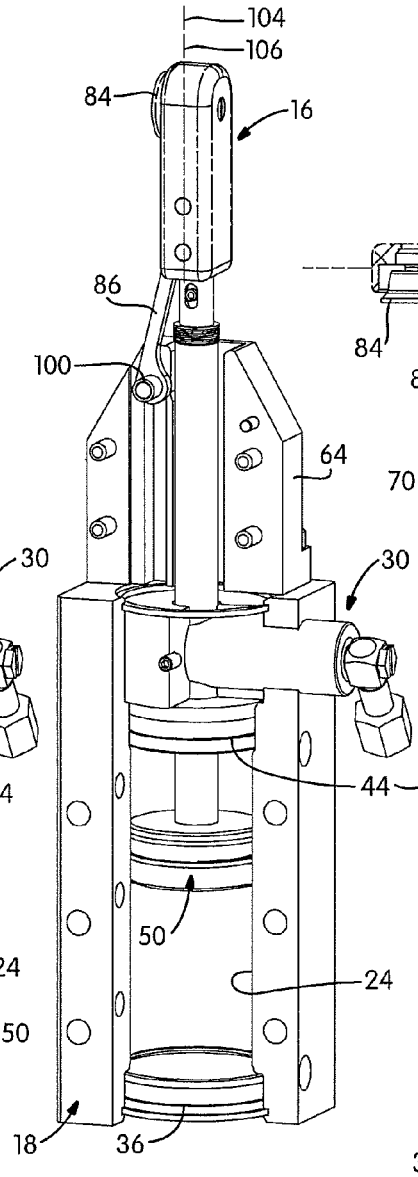
FIG. 5 is a cross-section view like FIG. 4 with the piston rod in an extended position.
Figure 6:
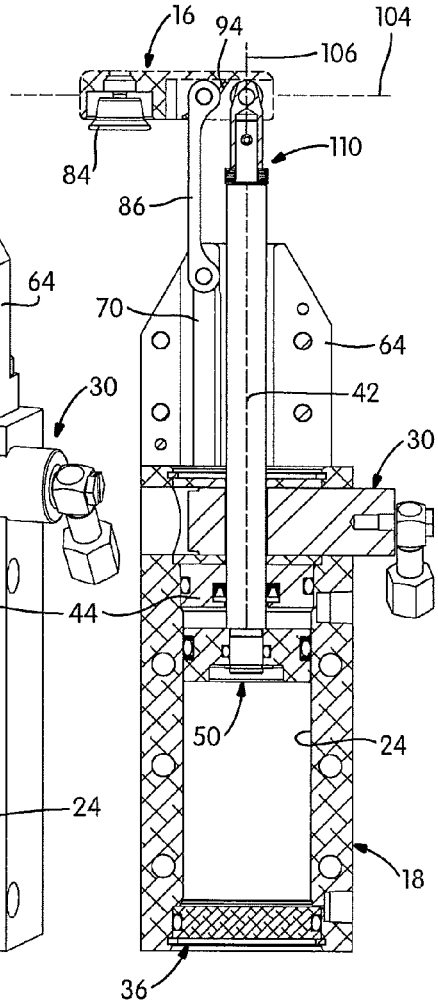
FIG. 6 is a cross-section view along line 6-6 of FIG. 1.

The piston assembly 14 includes a piston rod 42, a rod gland 44 and seal 46, as well as a piston 48 and piston seals 50. Additionally, a seal 52 is positioned on the interior of the piston 48 sealing the piston 48 with the piston rod 42. The piston assembly 14 moves between an open and closed position as illustrated in FIGS. 4, 5 and 6. As fluid enters the cylindrical bore 24, the piston rod 42 moves upwardly moving the clamping arm 16 from an unclamped to a clamped position.

The rod lock assembly 30 includes a rod lock retainer 54, as well as a rod lock 56. The piston rod 42 is passed through the rod lock retainer 54 as well as the rod lock 56. Both include apertures to receive the piston rod 42. The rod lock 56 includes a coupling that couples the rod lock 56 to a fluid source. When fluid enters into the rod lock 56, it moves inwardly releasing the piston rod 42 from the rod lock assembly 30. When fluid pressure is removed from the rod lock 56, the rod lock 56 maintains the piston rod 42 in a locked position with the rod lock retainer. A retaining ring 58 maintains the rod lock retainer 54 and rod lock 56 in the cylinder bore 24.

The housing head 20 includes a pair of body halves 62 and 64. The body halves 62, 64 define a channel 66 that enables movement of the piston rod 42 through the housing head 20. The housing head 20 is secured with the housing 18 via fasteners 68. An additional channel 70 is formed by the body halves 62, 64. The channel 70 enables movement of a retaining link 86.

The arm assembly 16 includes an arm 72 having an elongated configuration. At one end, the arm 72 includes a pair of apertures 74 that receive a pin 76 that retains the arm onto the piston rod 42. The piston rod 42 includes an aperture 78 that receives the pin 76 fixing the arm 72 to the piston rod 42. The other end of the arm includes an aperture 80. The aperture 80 receives a fastener 82 to retain a clamp pad 84 onto the arm 72. The clamp pad 84 swivels with respect to the arm 72 through an angle of approximately 15°.

A retaining link 86 is coupled with the arm 72. A pin 88 passes through apertures 90 in the arm 72 and aperture 92 in the retaining link 86 to secure one end of the retaining link 86 with the arm 72. Additionally, a biasing member 94, such as a torsion spring, is secured by the pin 88 with the arm 72 and retaining link 86. The retaining link 86 includes a second end with an aperture 96. The aperture 96 receives a pin 98 that includes bushings 100, 102. The bushings 100, 102 fit in the channel 70 so that the retaining link 86 moves in the channel 70 in response to movement of the piston rod 42. The torsion spring 94 maintains the arm 72 in a first or unclamped position such that the arm axis 104 is parallel with the piston axis 106. Thus, the biasing member or spring 94 maintains the arm in the position illustrated in FIGS. 4 and 5.

Compliance device 110 is positioned onto the end of the piston rod 42. The compliance device 110 includes a plurality of disk springs 112 and a disk spring retainer 114. The disk springs 112 are positioned onto the piston rod stud 120 and seat on a shoulder 116 between the stud 120 and the piston rod 42. The retainer 114 is positioned on top of the disk springs 112. The pin 76 passes through an aperture 118 in the disk spring retainer 114 to maintain the compliance device 110 on the piston rod stud 120.

The clamp is in a stowed position illustrated in FIGS. 2 and 4. As can be seen, the clamping arm 72 is flush with the fixture in the stowed, unclamped or retracted position. When the arm 72 is in the retracted position, no more than a 3 mm gap is permissible between the arm 72 and the fixture. When the clamp 10 is activated, the rod lock assembly 30 is activated to enable the piston rod 42 to move within the cylinder bore 24 of the housing 18. As fluid enters the cylinder bore 24, the piston 48 moves upward moving the piston rod 42 toward its second position. As this occurs, the arm 72, still in a position with its axis parallel with the piston rod axis, moves upward as seen in FIG. 5. The torsion spring 94 maintains the arm 72 in the parallel position illustrated in FIGS. 4 and 5. As the piston rod 42 reaches the top of its stroke, the link pin 98, via bushing 100, 102, contacts the end of the channel 70 as seen in FIG. 6. As this occurs, the retaining link 86 pivots the arm 72 in a position such that its axis 104 is substantially perpendicular to the axis 106 of the piston rod 42 as illustrated in FIG. 6. Once in the clamping position, fluid pressure in the rod lock assembly 30 is released. This moves the rod lock assembly 30 into a locked position. The clamp 10 is now in its clamping position as seen in FIG. 6. The compliance device 110 provides additional force should the rod lock assembly include any play or slippage. Thus, the disk springs 112 push the disk spring retainer 114 upward which, due to the pivot of the link pin 88, forces the end of the arm 72 as well as the clamp pad 84 downward against the workpiece.

Thus, the arm 72 is locked in a clamping position without the use of a toggle lock. The clamp 10 is designed to operate in a vacuum at temperatures of approximately 300°. The clamp 10 does not include any external lubrication nor does it include a TEFLON® coating or lubricant. The arm 72 is smooth and free from sharp edges or burrs.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. A clamp comprising:

a housing;

a piston assembly in the housing, the piston assembly including a piston rod moving between a first and second position;

a piston rod lock assembly directly coupled with and surrounding the pistol rod for locking the piston rod in any locked position when the piston rod lock assembly is engaged, the piston rod lock assembly positioned in the housing; and an arm coupled with the piston rod, the arm moving in and out of the housing between a clamped and an unclamped position so that an arm axis is substantially aligned with a piston rod axis.

2. The clamp of claim 1, wherein said arm defines a longitudinal axis and said longitudinal axis moving from a position parallel to said piston rod, when in the unclamped position and inside the housing, to a position perpendicular to the piston rod, when in a clamped position outside the housing.

3. The clamp of claim 2, further comprising a biasing member that maintains the arm in the position parallel to the piston rod.

4. The clamp of claim 2, further comprising a link coupled with the arm and the housing, the link moving the arm into the position perpendicular to the piston rod.

5. The clamp of claim 1, wherein the rod lock assembly is activated between an ordinarily locked position, when the piston rod lock assembly is deactivated, and an unlocked position, when the piston rod lock assembly is activated.

6. The clamp of claim 1, wherein the housing includes a cylinder body and a head assembly.

7. The clamp of claim 1, further comprising a clamp pad on the arm, the clamp pad contacting being able to swivel.

8. A clamp comprising:

a housing;

a piston assembly in the housing, the piston assembly including a piston rod moving between a first and a second position;

a piston rod lock assembly surrounding the piston rod, the piston rod lock assembly directly contacting the piston rod for locking it in position;

an arm coupled with the piston rod, the arm moving between a clamped and an unclamped position; and the arm defines a longitudinal axis and the longitudinal axis moving from a position parallel to the piston rod inside the housing, when the arm is in the unclamped position, to a position substantially perpendicular to the piston rod outside the housing, when the arm is in the clamped position.

9. The clamp of claim 8, further comprising a biasing member that maintains the arm in the position parallel to said piston rod.

10. The clamp of claim 8, further comprising a link coupled with the arm and the housing, the link moving the arm into the position perpendicular to the piston rod.

11. The clamp of claim 8, further comprising a non-toggle mechanism for locking the piston rod.

12. The clamp of claim 11, wherein the non-toggle mechanism includes a rod lock that is activated between an ordinarily locked position, when the rod lock is deactivated, and an unlocked position, when the rod lock is activated.

13. The clamp of claim 8, wherein the housing includes a cylinder body and a head assembly.

14. A clamp comprising:

a housing;

a piston assembly in the housing, the piston assembly including a piston rod moving between a first and a second position;

an arm coupled with the piston rod, the arm moving between a clamped and an unclamped position;

the arm defines a longitudinal axis and the longitudinal axis moving from a position parallel to the piston rod, when in the unclamped position, to a position substantially perpendicular to the piston rod, when in the clamped position; and a non-toggle mechanism for locking the piston rod wherein the non-toggle mechanism is coupled with the piston rod and is engageable along the piston rod at any position along the piston rod for locking the piston rod when the non-toggle mechanism is engaged so that an angular orientation of the non-toggle mechanism with respect to the piston rod is a same in both an unlocked and locked position.

15. The clamp of claim 14, further comprising a biasing member that maintains the arm in the position parallel to the piston rod.

16. The clamp of claim 14, further comprising a link coupled with the arm and the housing, the link moving said arm into the position perpendicular to the piston rod.

17. The clamp of claim 14, wherein the non-toggle mechanism is a rod lock that is activated between the ordinarily locked position, when the rod lock is deactivated, and the unlocked position, when the rod lock is activated.

* * * * *

UNITED STATES PATENT AND TRADEMARK OFFICE

CERTIFICATE OF CORRECTION

PATENT NO. : 8,918,968 B2
APPLICATION NO. : 12/944024
DATED : December 30, 2014
INVENTOR(S) : Matthew Rentz It is certified that error appears in the above-identified patent and that said Letters Patent is hereby corrected as shown below:

In the Claim

Column 4
Line 41, claim 1 "pistol" should be --piston--

Signed and Sealed this
Fifth Day of May, 2015

Michelle K. Lee

Michelle K. Lee
*Director of the United States Patent and Trademark Office*